United States Patent [19]

Gwozdz et al.

[11] 4,099,753

[45] Jul. 11, 1978

[54] AUTOMATIC LOCKING MECHANISM FOR ONE OF A PAIR OF HINGED DOORS

[75] Inventors: Joseph W. Gwozdz, Clark Summit; James E. Biesecker, Gouldsboro; Charles R. Snyder, Factoryville, all of Pa.

[73] Assignee: McKinney Manufacturing Company, Scranton, Pa.

[21] Appl. No.: 761,687

[22] Filed: Jan. 24, 1977

[51] Int. Cl.[2] ..... E05C 7/06

[52] U.S. Cl. ..... 292/177; 292/21; 292/34; 292/92; 292/DIG. 21; 292/DIG. 44; 292/DIG. 66

[58] Field of Search ..... 292/34, 182, 140, 139, 292/165, DIG. 44, DIG. 66, DIG. 21, 32, 37, 170, 177, 164, 92, 21; 49/366, 394

[56] References Cited

U.S. PATENT DOCUMENTS

| | | | |
|---|---|---|---|
| 2,034,570 | 3/1936 | Flavin | 292/182 X |
| 3,388,938 | 6/1968 | Peterson | 292/177 |
| 3,578,369 | 5/1971 | Coopersmith | 292/58 |
| 3,582,122 | 6/1971 | Foster et al. | 292/DIG. 21 X |
| 3,718,922 | 2/1973 | Williams et al. | 292/DIG. 66 X |
| 4,005,886 | 2/1977 | Lirette | 292/177 |

FOREIGN PATENT DOCUMENTS

| | | | |
|---|---|---|---|
| 11,378 of | 1901 | United Kingdom | 292/182 |

*Primary Examiner*—Roy D. Frazier
*Assistant Examiner*—William E. Lyddane
*Attorney, Agent, or Firm*—Brown, Murray, Flick & Peckham

[57] ABSTRACT

A lock housing is adapted to be mounted at the free vertical edge of the inactive one of a pair of hinged doors that have adjacent vertical edges when both doors are closed. Slidably mounted in the housing is an axially movable shaft that extends vertically therefrom and has a normally retracted latch bolt mounted on its outer end. Operatively connected to the opposite end of the shaft is the inner end of a rocker arm, the central part of which is pivotally connected to the housing on a horizontal axis. A cam pivotally connected on a vertical axis to the housing normally projects from it for engagement by the free vertical edge of the active door for swinging the cam into the housing to swing the rocker arm vertically in order to project the latch bolt from a horizontal edge of the inactive door. The rocker arm is so mounted in the housing that it will be moved by the cam bodily away from the free edge of the door if the shaft cannot move, whereby the mechanism will not be damaged.

5 Claims, 11 Drawing Figures

Fig. 1
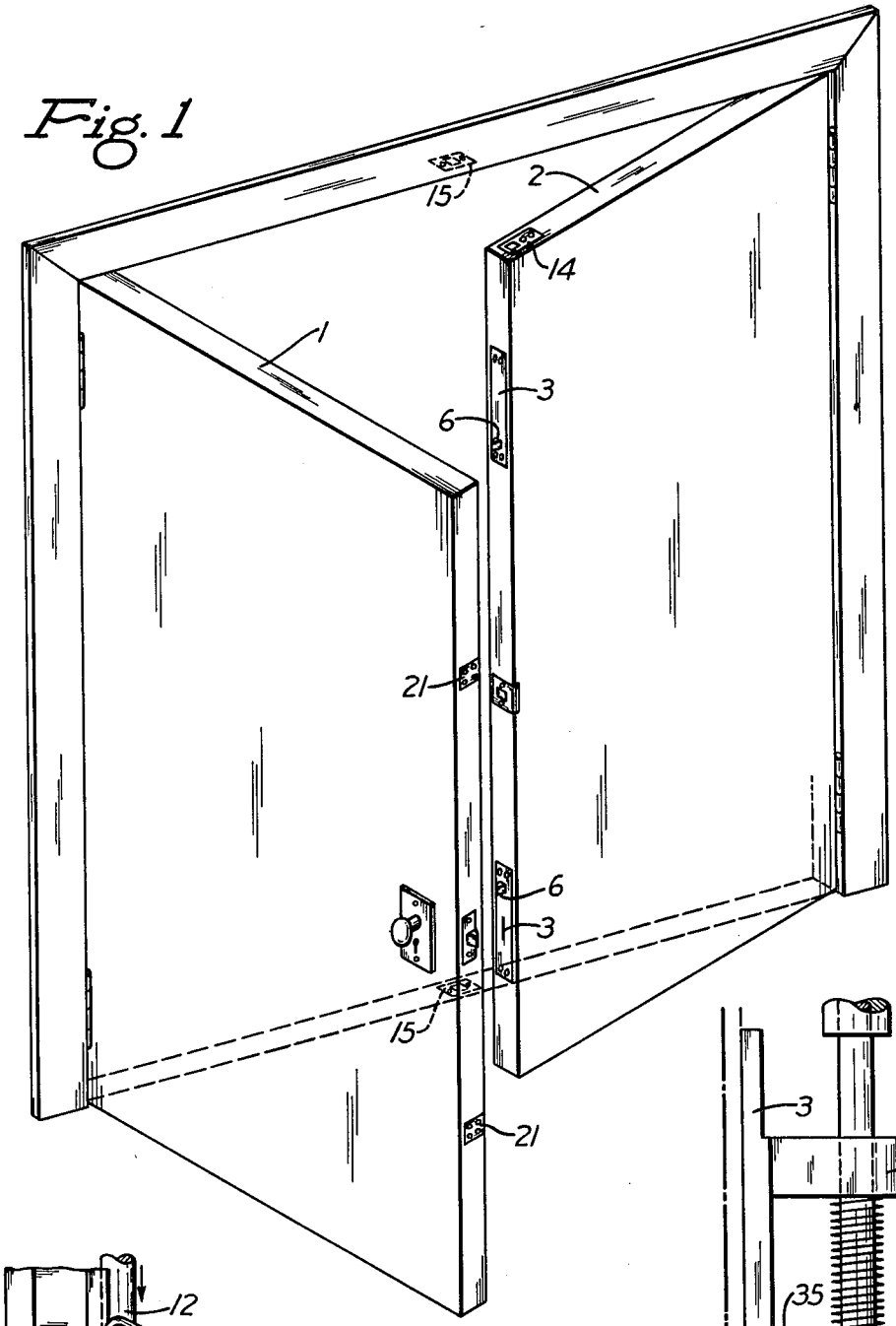
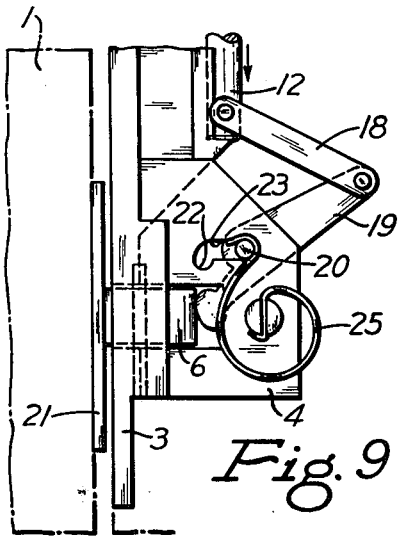
Fig. 9
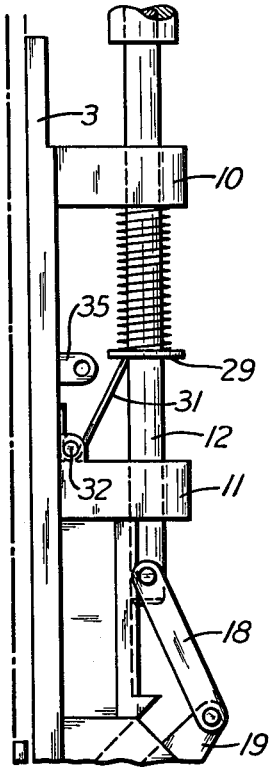
Fig. 10

AUTOMATIC LOCKING MECHANISM FOR ONE OF A PAIR OF HINGED DOORS

U.S. Pat. No. 3,578,369 shows a self-operating extension flush bolt or locking mechanism for the inactive door of a pair of hinged doors. When the inactive door is in closed position and the active door then is closed, the latter will engage a cam projecting from the inactive door and cause a latch bolt to project from a horizontal edge of the door and into a keeper in the top of the door frame or in the door sill. The patented locking mechanism requires considerable force to operate the bolt, which makes it necessary to use a heavy-duty door closer for the active door. Also, if the latch bolt is not aligned with the keeper when the active door is closed, damage may occur to the locking mechanism. To overcome these problems, others have provided a locking mechanism that requires less force to operate it and that has a spring override mechanism that prevents damage when the bolt and keeper are not aligned, but such a mechanism is rather complicated.

It is among the objects of this invention to provide automatic locking mechanism of the general type just discussed which is less complicated than those known heretofore, which does not require much force to operate the latch bolt and which will not become damaged or cause any damage if the bolt and keeper are not aligned when the doors are closed. Another object is to provide such a mechanism which, in case of fire, will maintain the inactive door securely locked.

The preferred embodiment of the invention is illustrated in the accompanying drawings, in which FIG. 1 is a perspective view of a doorway with both doors partly open;

FIG. 9 is a fragmentary side view showing the position of the movable elements of the locking mechanism when both doors are closed but the latch bolt does not enter the keeper;

FIG. 10 is a fragmentary side view showing the mechanism held in locked position during a fire.

Figure 2:
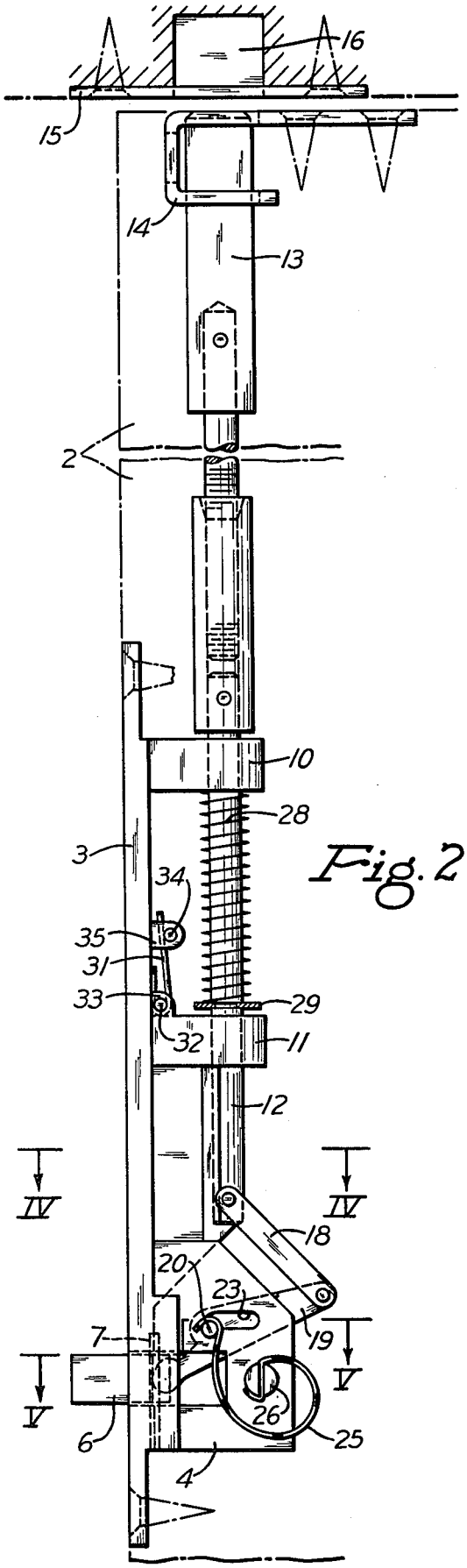
FIG. 2 is an enlarged side view of the upper locking mechanism in a closed but unlocked inactive door.

Referring to FIG. 1 of the drawings, a pair of hinged doors are shown which have adjacent free vertical edges when closed. One of these doors is referred to as the active door 1 and the other as the inactive door 2. This invention is concerned with the locking mechanism applied to the inactive door and actuated by the active door when the latter is closed manually or by means of a door closer. To accommodate the locking mechanism, the free edge of the inactive door is mortised, preferably in two vertically spaced locations to provide recesses that receive housings for upper and lower locking mechanisms. Since the two mechanisms are alike, only the upper one will be described.

As shown in FIGS. 1, 2, 4, 5 and 7, this upper housing includes a face plate 3 that is screwed onto the edge of the door and that has near its lower end a pair of inwardly extending but laterally spaced side walls 4. The face plate in front of these side walls is provided with a horizontal slot 5 in which a cam 6 is disposed. One end of the cam is pivotally mounted on a veritical pivot pin 7 at one side of the housing. The other side of the housing is provided with holes 8 to receive the pivot pin when the housing is to be inverted for use with a lower locking mechanism, thus making the housing interchangeable. The cam normally projects from the face plate.

Spaced above the side walls 4 of the housing are a pair of vertically spaced bosses 10 and 11, as shown in FIG. 2, projecting inwardly from the face plate and provided with aligned vertical openings, in which a shaft 12 is slidably mounted. The upper end of the shaft extends into the lower end of a latch bolt 13 and is secured to it. The upper end portion of the bolt is slidably mounted in a guide 14 mortised into the top of the door. Above this guide there is a jamb strike or keeper 15 provided with an opening 16 for receiving the upper end of the bolt when it is pushed upwardly out of the door.

Figure 8:
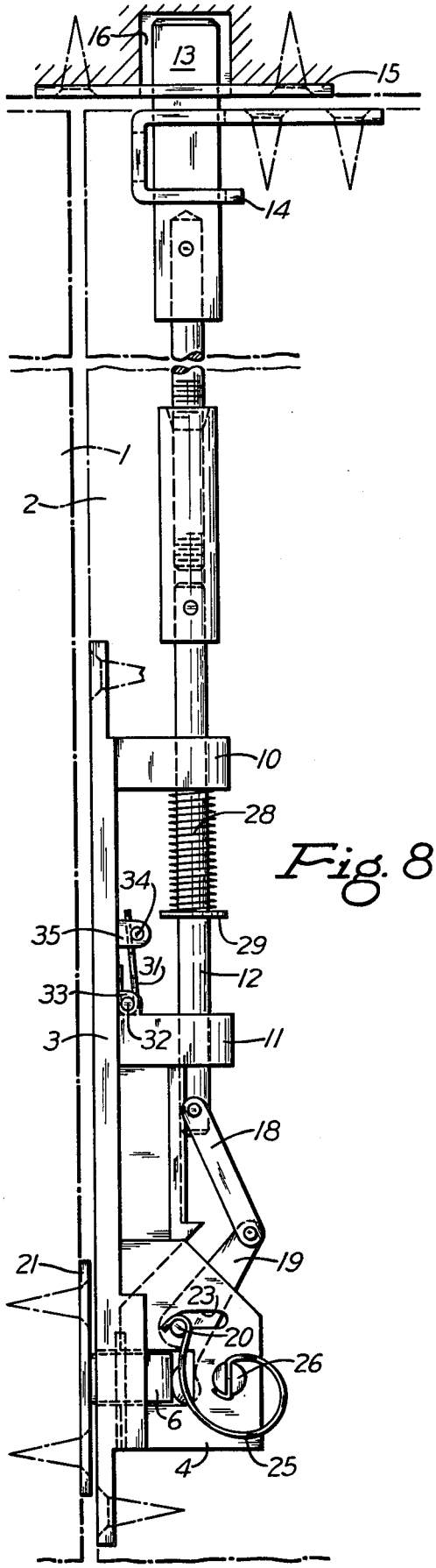
FIG. 8 is a side view similar to FIG. 2, but with the door locked.
Figure 3:
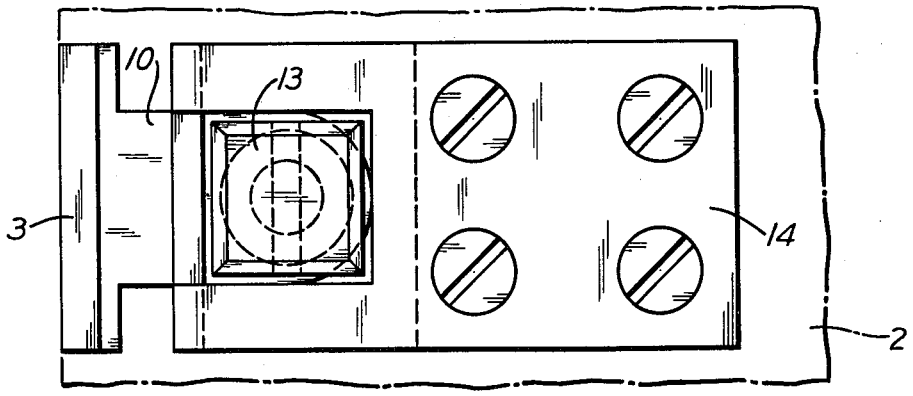
FIG. 3 is an enlarged fragmentary plan view of the inactive door showing the upper end of the locking mechanism.
Figure 4:
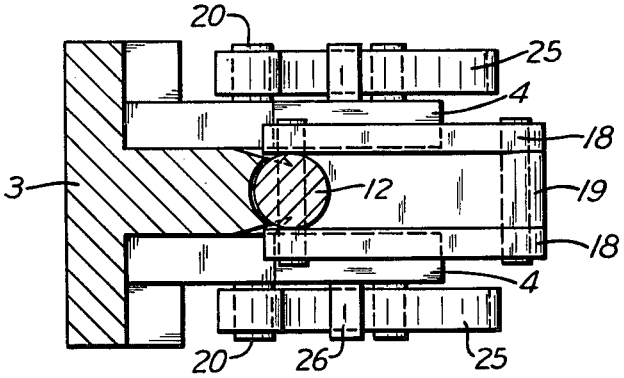
FIGS. 4 and 5 are enlarged horizontal sections taken on the lines IV—IV and V—V, respectively, of FIG. 2.
Figure 5:
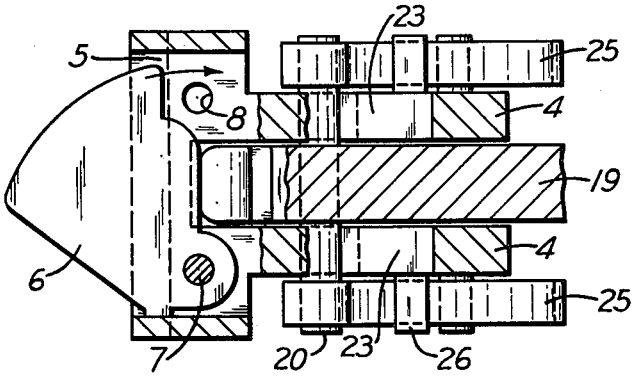

Pivotally connected on a horizontal axis to the lower end of shaft 12 are the upper ends of a pair of downwardly and inwardly inclined links 18, the lower ends of which straddle the inner end of a rocker arm 19, to which they are pivotally connected. The rocker arm is disposed between the two side walls 4 and has a pin extending through its central portion and projecting from its opposite sides to form trunnions 20. The outer end of the rocker arm engages the inner face of cam 6. The trunnions are pivotally mounted in openings in the housing side walls so that when the cam is swung inwardly by the closing active door 1, the adjoining end of the rocker arm will be swung downwardly on its trunnions, which will cause its opposite end to swing upwardly and, through links 18, raise the shaft and the latch bolt to lock the door as shown in FIG. 8. The edge of the active door may be provided with a strike plate 21 for engaging the cam. It requires only a moderate amount of pressure of the active door against the cam to project the latch bolt from the inactive door.

It is a feature of this invention that the connection between the rocker arm and the supporting housing side walls is such that, in case the latch bolt is not aligned with the opening in the keeper when the active door is closed, the locking mechanism will not be damaged and will not cause any damage. This desirable result is due to the fact that if the bolt cannot be moved because of misalignment, rocker arm 19 will be moved bodily away from face plate 3 of the housing and will not cause links 18 to attempt to raise the shaft. The preferred way of accomplishing this is to mount the rocker arm trunnions 20 in upwardly opening notches 22 (FIG. 9) in the side walls 4 of the housing, and to extend inwardly from above the notches slots 23, along which the trunnions can slide if they are raised out of the notches. The natural tendency of the rocker arm, when the cam presses against it, is to lift its trunnions out of the notches. To facilitate movement of the trunnions along the slots when the latch bolt is jammed, the front walls of the slots preferably are inclined forward so that as the trunnions move upwardly they also will start to move back in the slots.

The trunnions normally are held in the notches by springs, so that the ordinary unrestrained operation of the locking mechanism will not lift the trunnions out of the notches. Preferably, each spring is a coiled wire or metal strip 15, one end of which is looped over the adjoining trunnion. The opposite end of the spring is anchored in a boss 26 projecting from the side wall of the housing. The spring is coiled in a direction that causes it to hold the trunnion down in the notch as long as the latch bolt can be projected into the keeper. In the case of misalignment, however, the springs will yield and permit the trunnions to be forced up out of the notch and inwardly along the slots as shown in FIG. 9. This bodily inward movement of the rocker arm accommodates the movement of cam 6 without putting noticeable pressure on shaft 12, so no damage is done to the locking mechanism or to the door frame above the door.

For quickly retracting the latch bolt whenever the active door is opened and for also projecting the cam from face plate 3 at that time, a coil spring 28 encircles shaft 12 between the two bosses 10 and 11 on the face plate. The upper end of the spring engages the bottom of the upper boss and the lower end of the spring engages a projection on the shaft, such as a collar 29. When the latch bolt is projected to lock the door, this spring is compressed.

Another feature of this invention is that in case of fire, when the active door might be opened or warp under heat and allow cam 6 to swing out of face plate 3 so that the inactive door will be unlocked, means is provided for holding bolt 13 in locked position. This means may take the form of a spring that normally is held compressed by a fusible member as shown in FIGS. 2 and 8. Thus, a wire or metal strip spring 31 extends under a pin 32 mounted in ears 33 projecting upwardly from the lower boss 11 close to the face plate. One end portion of the spring lies against the face plate, while the opposite end extends up between a low temperature fusible pin 34 and the face plate. The ends of the fusible pin are mounted in ears 35 projecting from the face plate. This pin is close enough to the face plate to compress the spring, which otherwise would bear against shaft 12. Consequently, if the heat from a fire melts the fusible link while the inactive door is locked, in which case collar 29 would be in its upper position spaced from the lower boss, spring 31 will be released and its released end will spring out into engagement with the shaft just below the collar as shown in FIG. 10, because the length of the spring is designed for that purpose. The spring then will prevent the collar and the shaft attached to it from moving downwardly even if cam 6 is released, so the door will remain locked.

Figure 11:
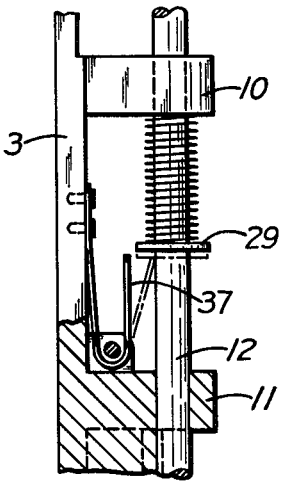
FIG. 11 is a similar view of a modification.
Figure 6:
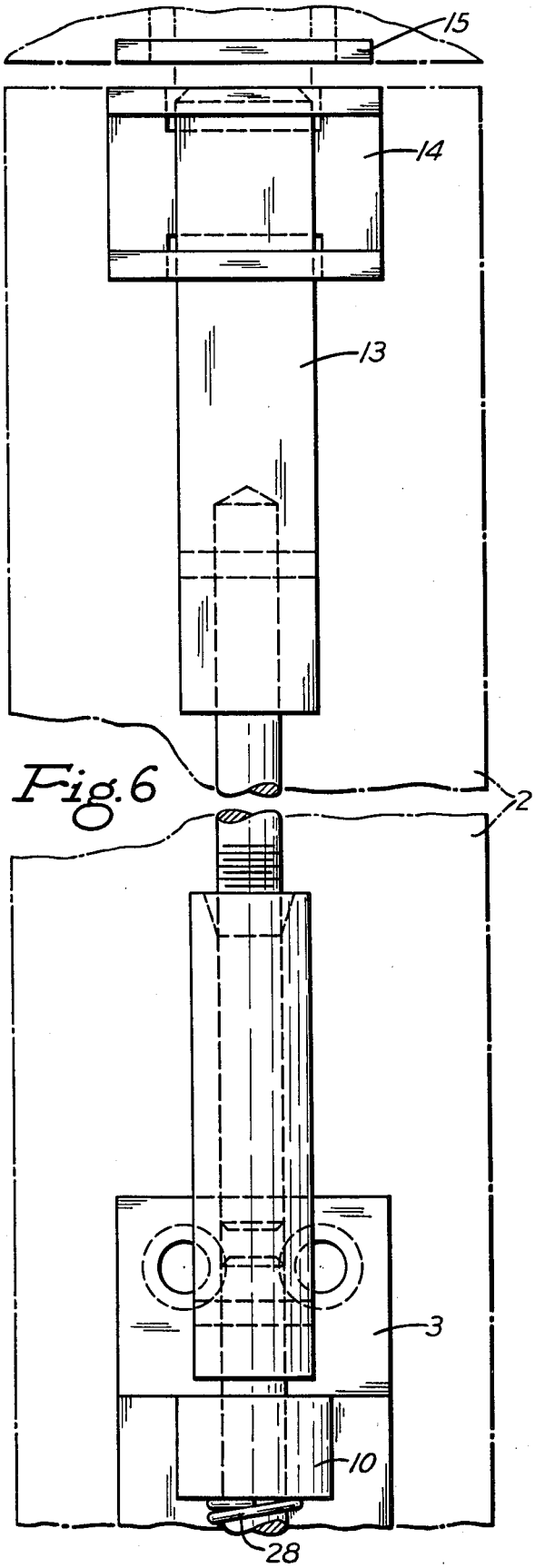
FIG. 6 is an enlarged fragmentary view of the upper part of the upper locking mechanism, looking toward the edge of the door.
Figure 7:
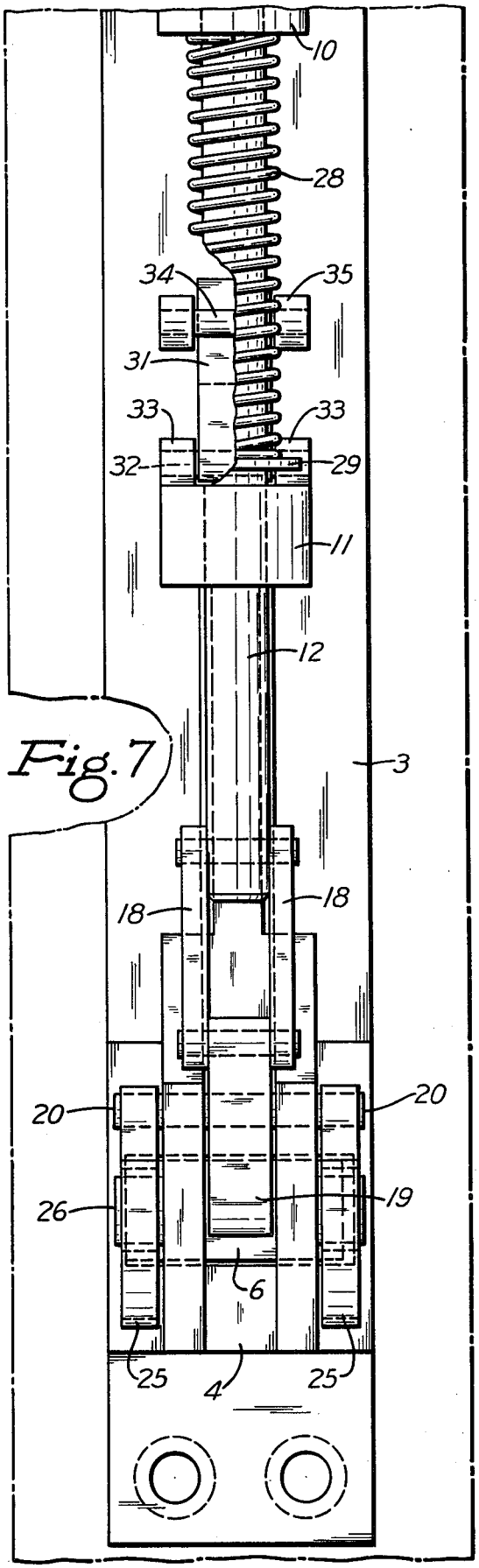
FIG. 7 is a similar view of the lower part of the locking mechanism.

Another way of accomplishing the same result is shown in FIG. 11, in which a J-shaped bimetallic strip 37 is used in place of spring 31. One end of this bimetallic strip is attached to face plate 3, but the opposite end is free and normally will be spaced from collar 29 while the lock is being operated. However, in case of fire while the door is locked, if the strip becomes heated the free end will swing out beneath the raised collar 29 as shown in dotted lines and will thereby prevent the bolt from coming out of the keeper even if cam 6 is released.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. Automatic locking mechanism for one of a pair of hinged doors having adjacent free vertical edges when both doors are closed, one of the doors being active and the other being inactive, said mechanism comprising a housing adapted to be mounted on the inactive door, an axially movable vertical shaft slidably mounted in said housing and extending vertically therefrom, a normally retracted latch bolt rigidly mounted on the end of said shaft remote from the housing, an inclined link having one end pivotally connected on a horizontal axis to the opposite end of the shaft, a rocker arm having an inner end and an outer end, means pivotally connecting the other end of said link on a horizontal axis to the inner end of the arm, a cam pivotally connected on a vertical axis to said housing and normally projecting therefrom for engagement by the free vertical edge of the active door when closing for swinging the cam into the housing, aligned trunnions projecting from the opposite sides of the central part of the rocker arm, said housing being provided with notches pivotally receiving said trunnions and with slots extending from said notches in a direction away from said cam, the cam engaging the outer end of the rocker arm for swinging the arm vertically to cause the link and shaft to project said latch bolt from a horizontal edge of the inactive door, said slots communicating with said notches to permit the trunnions to be moved towards said shaft and then along the slots if said cam is swung into said housing and the shaft cannot move, and spring means normally holding the trunnions in said notches.

2. Automatic locking mechanism according to claim 1, in which the end wall of said slots adjacent the notches is inclined from the notches toward said link.

3. Automatic locking mechanism according to claim 1, in which said spring means include a pair of springs having one end looped over said trunnions and having the opposite end secured to the outside of said housing.

4. Automatic locking mechanism for one of a pair of hinged doors having adjacent free vertical edges when both doors are closed, one of the doors being active and the other being inactive, said mechanism comprising a housing adapted to be mounted on the inactive door and including a face plate provided with an opening therethrough, an axially movable vertical shaft slidably mounted in said housing and extending vertically therefrom, a normally retracted latch bolt rigidly mounted on the end of said shaft remote from the housing, a rocker arm having an inner end and an outer end, an inclined link having one end pivotally connected on a horizontal axis to the opposite end of the shaft and extending therefrom away from said face plate, means pivotally connecting the other end of said link on a horizontal axis to the inner end of said arm, means connecting the central part of said arm on a horizontal axis to said housing for pivotal and translational movement, a cam pivotally connected on a vertical axis to said housing and normally projecting through said face plate opening for engagement by the free vertical edge of the active door when closing for swinging the cam into the housing, the cam engaging the outer end of the rocker arm for swinging the arm vertically to cause the link and shaft to project said latch bolt from a horizontal edge of the inactive door, said central part of said arm being movable by the cam in a direction away from the face plate if the cam is swung into the housing and the shaft cannot move, and spring means constantly urge said pivoted central part of the arm toward the face plate.

5. Automatic locking mechanism according to claim 4, in which said means pivotally connecting the rocker arm to said housing include aligned trunnions projecting from the opposite sides of the arm and, said housing is provided with slots receiving said trunnions and extending inwardly away from said face plate to permit the trunnions to be moved inwardly along the slots if the cam is swung into the housing when the shaft cannot move.

* * * * *